US011815084B2

(12) United States Patent
Kondo et al.

(10) Patent No.: US 11,815,084 B2
(45) Date of Patent: Nov. 14, 2023

(54) HYDRAULIC SYSTEM

(71) Applicant: KAWASAKI JUKOGYO KABUSHIKI KAISHA, Kobe (JP)

(72) Inventors: Akihiro Kondo, Kobe (JP); Hiroaki Mitsui, Kobe (JP); Toshihisa Toyota, Kobe (JP); Koki Mibu, Kobe (JP); Takashi Nakatsuji, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 184 days.

(21) Appl. No.: 17/295,245

(22) PCT Filed: Nov. 15, 2019

(86) PCT No.: PCT/JP2019/044916
§ 371 (c)(1),
(2) Date: May 19, 2021

(87) PCT Pub. No.: WO2020/105560
PCT Pub. Date: May 28, 2020

(65) Prior Publication Data

US 2022/0010792 A1 Jan. 13, 2022

(30) Foreign Application Priority Data

Nov. 19, 2018 (JP) ..... 2018-216518

(51) Int. Cl.
*F04B 49/08* (2006.01)
*F04B 49/06* (2006.01)
*F15B 13/04* (2006.01)

(52) U.S. Cl.
CPC ..... *F04B 49/08* (2013.01); *F04B 49/065* (2013.01); *F15B 13/0416* (2013.01);
(Continued)

(58) Field of Classification Search
CPC .... F04B 49/065; F04B 49/08; F04B 2205/05; F04B 1/295; F04B 1/324; F04B 17/03;
(Continued)

(56) References Cited

U.S. PATENT DOCUMENTS 6,527,540 B1 * 3/2003 Dantlgraber ..... B29C 45/82 425/589
2007/0079609 A1 * 4/2007 Brinkman ..... F15B 21/14 60/413

(Continued)

FOREIGN PATENT DOCUMENTS

JP H07-127606 A 5/1995
JP 2004-176893 A 6/2004

(Continued)

*Primary Examiner* — Alexander B Comley
(74) *Attorney, Agent, or Firm* — Oliff PLC

(57) ABSTRACT

A hydraulic system includes: a cylinder that moves a moving object in a vertical direction by extension and retraction of a rod; a first bidirectional pump connected to a head-side chamber of the cylinder by a first supply/discharge line; a second bidirectional pump connected to a rod-side chamber of the cylinder by a second supply/discharge line and coupled to the first bidirectional pump in a manner enabling torque to be transmitted between the first and second bidirectional pumps; a relay line connecting the first and second bidirectional pumps such that a hydraulic liquid discharged from one of the first and second bidirectional pumps is introduced into the other of the first and second bidirectional pumps; and a servomotor that drives the first or second bidirectional pump. At least one of the first and second bidirectional pumps is a variable displacement pump whose delivery capacity per rotation is freely variable.

10 Claims, 4 Drawing Sheets

(52) U.S. Cl.
CPC . *F04B 2205/05* (2013.01); *F15B 2211/20515* (2013.01); *F15B 2211/20546* (2013.01); *F15B 2211/20561* (2013.01)

(58) Field of Classification Search
CPC .. F04B 23/04; F04B 23/08–14; F04B 49/007; F15B 2211/20515; F15B 2211/20546; F15B 2211/20561; F15B 13/0416
See application file for complete search history.

(56) References Cited

U.S. PATENT DOCUMENTS

| | | | | |
|---|---|---|---|---|
| 2012/0240566 | A1* | 9/2012 | Ohtsuka | E02F 9/2296 60/413 |
| 2015/0107236 | A1* | 4/2015 | Udagawa | E02F 9/2217 60/430 |

FOREIGN PATENT DOCUMENTS

| | | | | |
|---|---|---|---|---|
| JP | 2004-301189 | A | | 10/2004 |
| JP | 2004301189 | A | * | 10/2004 |
| JP | 4402830 | B2 | | 1/2010 |

* cited by examiner

HYDRAULIC SYSTEM

TECHNICAL FIELD

The present invention relates to a hydraulic system including a cylinder.

BACKGROUND ART

For example, a known hydraulic system incorporated in a press machine or the like includes a cylinder that moves a moving object such as a movable die in the vertical direction and a bidirectional pump connected to the cylinder such that a closed circuit is formed. The bidirectional pump is typically driven by a servomotor.

For example, Patent Literature 1 discloses a hydraulic system 100 as shown in FIG. 4 which is incorporated in a press machine. In this hydraulic system 100, the interior of a tube 111 closed at both ends is divided by a piston into an upper head-side chamber 114 and a lower rod-side chamber 113, and a moving object (movable die) 160 is lowered by extension of a rod 112 and raised by retraction of the rod 112.

The head-side chamber 114 of the cylinder 110 is connected to a bidirectional pump 140 by a first supply/discharge line 130, and the rod-side chamber 113 of the cylinder 110 is connected to the bidirectional pump 140 by a second supply/discharge line 120. The second supply/discharge line 120 is provided with a counterbalance valve 121. Further, a bypass line 122 is connected to the second supply/discharge line 120 in such a manner as to bypass the counterbalance valve 121, and the bypass line 122 is provided with a speed-switching valve 123.

The lowering speed of the moving object 160 is switched by the speed-switching valve 123 between an approaching speed which is relatively high and a working speed which is relatively low. That is, during pressing, a reactive force is applied against extension of the rod by means of the counterbalance valve 121.

CITATION LIST

Patent Literature

PTL 1: Japanese Patent No. 4402830

SUMMARY OF INVENTION

Technical Problem

In the configuration like that of the hydraulic system 100 shown in FIG. 4, where during pressing a reactive force is applied against extension of the rod by means of the counterbalance valve, the speed, stroke, and thrust of the cylinder can be stably controlled (hereinafter, the speed, stroke, and thrust of a cylinder will be collectively referred to as "the speed etc." of the cylinder). In some cases, the counterbalance valve is used to apply a reactive force against extension of the rod when the moving object is raised by extension of the rod. However, in such configurations using the counterbalance valve, energy loss occurs due to passing of the hydraulic liquid through the counterbalance valve.

The present invention aims to provide a hydraulic system able to stably control the speed etc. of a cylinder without the use of any counterbalance valve when a moving object is moved by extension of a rod.

Solution to Problem

In order to solve the problem described above, a hydraulic system of the present invention includes: a cylinder that moves a moving object in a vertical direction by extension and retraction of a rod and in which an interior of a tube is divided by a piston into a head-side chamber and a rod-side chamber; a first bidirectional pump connected to the head-side chamber by a first supply/discharge line; a second bidirectional pump connected to the rod-side chamber by a second supply/discharge line and coupled to the first bidirectional pump in a manner enabling torque to be transmitted between the first and second bidirectional pumps; a relay line connecting the first and second bidirectional pumps such that a hydraulic liquid discharged from one of the first and second bidirectional pumps is introduced into the other of the first and second bidirectional pumps; and a servomotor that drives the first or second bidirectional pump, wherein at least one of the first and second bidirectional pumps is a variable displacement pump whose delivery capacity per rotation is freely variable.

In the above configuration, since the second bidirectional pump is coupled to the first bidirectional pump in a manner enabling torque to be transmitted between the first and second bidirectional pumps, both the first and second bidirectional pumps are driven once one of the pumps is driven by the servomotor. Additionally, since at least one of the first and second bidirectional pumps is a variable displacement pump whose delivery capacity per rotation is freely variable, the delivery capacity ratio between the first and second bidirectional pumps can be appropriately set even if the rotational speed ratio between the first and second bidirectional pumps is constant. Thus, a reactive force can be applied against extension of the cylinder without the use of any counterbalance valve. In consequence, the speed etc. of the cylinder can be stably controlled when the moving object is moved by extension of the rod.

Further, during lowering of the moving object, the hydraulic oil discharged from the cylinder flows into the first or second bidirectional pump, and thus the potential energy of the moving object can be regenerated in the form of torque and rotational speed. At this time, since the delivery capacity ratio between the first and second bidirectional pumps can be appropriately set, the occurrence of cavitation due to an excessively low head-side pressure can be prevented, for example, in the case where the cylinder is disposed to lower the moving object by extension of the rod. In such a configuration, even if the delivery capacity of the first bidirectional pump and therefore the head-side pressure become excessively high, an extra pressure occurring on the rod side can be regenerated in the form of the torque of the second bidirectional pump. Thus, also in this case, the energy efficiency is higher than in conventional techniques.

The first bidirectional pump may be a variable displacement pump whose delivery capacity per rotation is freely variable, and the hydraulic system may further include a first regulator that regulates a tilt angle of the first bidirectional pump in response to an electrical signal, a servo amplifier that controls a rotational speed of the servomotor, a controller that outputs a rotational speed command to the servo amplifier and outputs a tilt angle command to the first regulator, and a head-side pressure sensor that detects a pressure in the head-side chamber or the first supply/discharge line. When the moving object is moved to a predetermined position by extension of the rod, the controller may output the rotational speed command to the servo amplifier such that the moving object is moved at a predetermined speed and output the tilt angle command to the regulator such that the pressure detected by the head-side pressure sensor is maintained within a predetermined range. In this configuration, the benefits mentioned above can be reliably obtained without being affected by that amount of internal leakage occurring in the second bidirectional pump which depends on the level of the pressure.

The second bidirectional pump may be a fixed displacement pump whose delivery capacity per rotation is invariable or a variable displacement pump whose delivery capacity per rotation is selectively switchable between a first fixed value and a second fixed value. In this configuration, the cost can be reduced compared to that required when both the first and second bidirectional pumps are variable displacement pumps whose delivery capacities per rotation are freely variable.

The hydraulic system may be incorporated in a press machine, and during pressing in which the moving object is further moved from the predetermined position by extension of the rod, the controller may output the rotational speed command to the servo amplifier such that the moving object is moved at a predetermined speed and output the tilt angle command to the regulator such that the pressure detected by the head-side pressure sensor increases to a target pressure. In conventional techniques, during pressing, it is inevitable in principle to maintain the head-side pressure while ensuring a reactive force by means of a counterbalance valve. In contrast, in the above configuration, a reactive force can be exerted during pressing while the energy is regenerated in the second bidirectional pump. This leads to improved energy efficiency of the press machine.

After the pressure detected by the head-side pressure sensor reaches the target pressure, the controller may output the rotational speed command to the servo amplifier such that the rotational speed of the servomotor becomes a predetermined value and output the tilt angle command to the regulator such that the pressure detected by the head-side pressure sensor is maintained at the target pressure. In this configuration, insufficiency of the head-side pressure for pressing force generation can be prevented, and the head-side pressure can be stably controlled at the target pressure.

The cylinder may lower the moving object by extension of the rod, the hydraulic system may further include a rod-side pressure sensor that detects a pressure in the rod-side chamber or the second supply/discharge line, and the servo amplifier may further control a regenerative torque of the servomotor, and when the moving object is lowered by its own weight, the controller may output a regenerative torque command to the servo amplifier such that the pressure detected by the rod-side pressure sensor becomes a predetermined value. In this configuration, when the moving object is lowered by its own weight, the head-side pressure can avoid becoming zero or a negative pressure, and thus the occurrence of cavitation can be prevented.

The second bidirectional pump may be a variable displacement pump whose delivery capacity per rotation is freely variable, and the hydraulic system may further include a second regulator that regulates a tilt angle of the second bidirectional pump in response to an electrical signal, a servo amplifier that controls a rotational speed of the servomotor, a controller that outputs a rotational speed command to the servo amplifier and outputs a tilt angle command to the second regulator, and a head-side pressure sensor that detects a pressure in the head-side chamber or the first supply/discharge line. When the moving object is moved to a predetermined position by extension of the rod, the controller may output the tilt angle command to the second regulator such that the delivery capacity of the second bidirectional pump becomes a predetermined value, output the rotational speed command to the servo amplifier such that the moving object is moved at a predetermined speed, and correct the rotational speed command output to the servo amplifier if the pressure detected by the head-side pressure sensor falls outside a predetermined range. In this configuration, the benefits mentioned above can be reliably obtained without being affected by that amount of internal leakage occurring in the second bidirectional pump which depends on the level of the pressure.

The first bidirectional pump may be a fixed displacement pump whose delivery capacity per rotation is invariable or a variable displacement pump whose delivery capacity per rotation is selectively switchable between a first fixed value and a second fixed value. In this configuration, the cost can be reduced compared to that required when both the first and second bidirectional pumps are variable displacement pumps whose delivery capacities per rotation are freely variable.

The hydraulic system may be incorporated in a press machine, and during pressing in which the moving object is further moved from the predetermined position by extension of the rod, the controller may output the rotational speed command to the servo amplifier such that the moving object is moved at a predetermined speed, adjust the rotational speed command output to the servo amplifier such that the pressure detected by the head-side pressure sensor increases to a target pressure, and adjust the tilt angle command output to the second regulator such that when the rotational speed has been increased, the tilt angle decreases as a function of the increase in the rotational speed and that when the rotational speed has been decreased, the tilt angle increases as a function of the decrease in the rotational speed. In this configuration, during pressing, the amount of change in the head-side pressure can be made smaller to achieve more stable control than when the tilt angle of the second bidirectional pump is kept constant.

For example, after the pressure detected by the head-side pressure sensor reaches the target pressure, the controller may continue the adjustment of the rotational speed command and the adjustment of the tilt angle command such that the pressure detected by the head-side pressure sensor is maintained at the target pressure.

The cylinder may lower the moving object by extension of the rod, the servo amplifier may further control a regenerative torque of the servomotor, the hydraulic system may further include a rod-side pressure sensor that detects a pressure in the rod-side chamber or the second supply/discharge line, and when the moving object is lowered by its own weight, the controller may output a regenerative torque command to the servo amplifier such that the pressure detected by the rod-side pressure sensor becomes a predetermined value. In this configuration, when the moving object is lowered by its own weight, the head-side pressure can avoid becoming zero or a negative pressure, and thus the occurrence of cavitation can be prevented.

Advantageous Effects of Invention

According to the present invention, the speed etc. of a cylinder can be stably controlled during lowering of a moving object.

DESCRIPTION OF EMBODIMENTS

Embodiment 1

Figure 1:
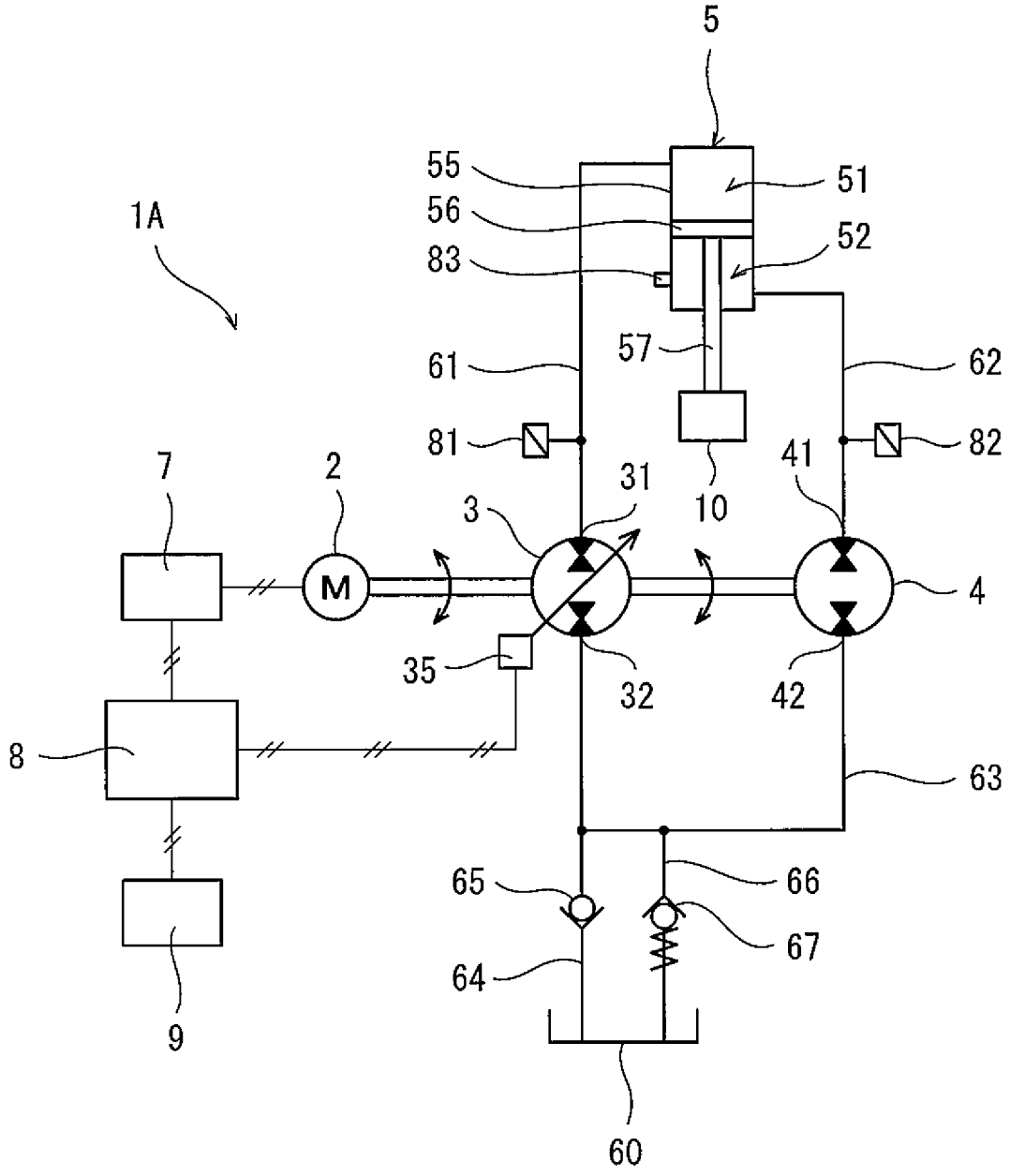
FIG. 1 is a schematic configuration diagram of a hydraulic system according to Embodiment 1 of the present invention.

FIG. 1 shows a hydraulic system 1A according to Embodiment 1 of the present invention. This hydraulic system 1A is incorporated in a press machine. The hydraulic liquid used in the hydraulic system 1A is typically an oil, and may be another liquid such as water.

The hydraulic system 1A includes a cylinder 5 that moves a movable die 10 as the moving object in the vertical direction. In the present embodiment, the cylinder 5 is disposed to lower the movable die 10 by extension of a rod 57 described later and raises the movable die 10 by retraction of the rod 57. The axial direction of the cylinder 5 need not be exactly parallel to the vertical direction, and may be slightly inclined with respect to the vertical direction (for example, the angle of inclination with respect to the vertical direction is 10 degrees or less).

The hydraulic system 1A further includes a first bidirectional pump 3 and a second bidirectional pump 4 which are connected to the cylinder 5 such that a closed circuit is formed. The closed circuit is connected to a tank 60 by an inlet line 64 and an outlet line 66.

The cylinder 5 includes: a tube 55 closed at both ends by a head cover and a rod cover; a piston 56 dividing the interior of the tube 55 into an upper head-side chamber 51 and a lower rod-side chamber 52; and the rod 57 extending downward from the piston 56 and penetrating through the rod cover. The movable die 10 is mounted on the tip of the rod 57.

The first bidirectional pump 3 includes a cylinder-side port 31 and a cylinder-opposite port 32 that switch between functioning as a suction port and functioning as a delivery port depending on the rotational direction of the pump. The cylinder-side port 31 is connected to the head-side chamber 51 of the cylinder 5 by a first supply/discharge line 61. The cylinder-side port 31 is designed to withstand high pressures, and the cylinder-opposite port 32 is held at a low pressure. Thus, the cylinder-opposite port 32 has a larger diameter than the cylinder-side port 31.

The second bidirectional pump 4 includes a cylinder-side port 41 and a cylinder-opposite port 42 that switch between functioning as a suction port and functioning as a delivery port depending on the rotational direction of the pump. The cylinder-side port 41 is connected to the rod-side chamber 52 of the cylinder 5 by a second supply/discharge line 62. The cylinder-side port 41 is designed to withstand high pressures, and the cylinder-opposite port 42 is held at a low pressure. Thus, the cylinder-opposite port 42 has a larger diameter than the cylinder-side port 41.

The cylinder-opposite port 42 of the second bidirectional pump 4 is connected to the cylinder-opposite port 32 of the first bidirectional pump 3 by a relay line 63. Thus, the hydraulic liquid discharged from one of the first and second bidirectional pumps 3 and 4 is introduced into the other of the first and second bidirectional pumps 3 and 4 through the relay line 63.

The inlet and outlet lines 64 and 66 mentioned above connect the relay line 63 and the tank 60. The inlet line 64 is provided with a check valve 65, and the outlet line 66 is provided with an outlet valve 67. The check valve 65 permits a flow from the tank 60 toward the relay line 63 and prohibits the opposite flow.

The outlet valve 67 permits a flow from the relay line 63 toward the tank 60 when the pressure in the relay line 63 is higher than a preset value (e.g., 0.1 to 2 MPa), and otherwise prohibits the flow between the relay line 63 and the tank 60. In the present embodiment, the outlet valve 67 is a check valve whose cracking pressure is set to a somewhat high value. Alternatively, the outlet valve 67 may be a relief valve.

The first and second bidirectional pumps 3 and 4 are coupled together in a manner enabling torque to be transmitted between them. In the present embodiment, the first and second bidirectional pumps 3 and 4 are coaxially arranged. For example, the rotating shafts of the first and second bidirectional pumps 3 and 4 are coupled directly by means such as a coupling.

Alternatively, a plurality of gears may be disposed between the rotating shafts of the first and second bidirectional pumps 3 and 4, and the first and second bidirectional pumps 3 and 4 may be arranged in parallel. In this case, the rotational speeds of the first and second bidirectional pumps 3 and 4 may be different.

In the present embodiment, the first bidirectional pump 3 is a variable displacement pump (a swash plate pump or bent axis pump) whose delivery capacity per rotation is freely variable, and the second bidirectional pump 4 is a fixed displacement pump whose delivery capacity per rotation is invariable.

The tilt angle of the first bidirectional pump 3, which defines the delivery capacity, is regulated by a first regulator 35. The first regulator 35 regulates the tilt angle of the first bidirectional pump 3 in response to an electrical signal. For example, when the first bidirectional pump 3 is a swash plate pump, the first regulator 35 may be a regulator that electrically varies the hydraulic pressure acting on a servo piston coupled to the swash plate of the first bidirectional pump 3, or may be an electric actuator coupled to the swash plate of the first bidirectional pump 3.

In the present embodiment, the first bidirectional pump 3 is driven by a servomotor 2. For example, the rotating shafts of the first bidirectional pump 3 and servomotor 2 are coupled directly by means such as a coupling. Alternatively, the rotating shaft of the servomotor 2 may be coupled to the rotating shaft of the second bidirectional pump 4, and the second bidirectional pump 4 may be driven by the servomotor 2. The rotational direction and rotational speed of the servomotor 2 are controlled by a servo amplifier 7. During lowering of the movable die 10, the servomotor 2 functions primarily as an electricity generator, and thus the regenerative torque of the servomotor 2 is controlled by the servo amplifier 7.

The first regulator 35 and the servo amplifier 7 are electrically connected to a controller 8. The controller 8 outputs a tilt angle command to the first regulator 35 and outputs a rotational direction command, a rotational speed command, and a regenerative torque command to the servo amplifier 7. For example, the controller 8 is a computer including memories such as a ROM and a RAM and a CPU, and a program stored in the ROM is executed by the CPU.

The controller 8 is electrically connected also to an input device 9, a head-side pressure sensor 81, and a rod-side pressure sensor 82. It should be noted that in FIG. 1, only some of the signal lines are shown for simplification of the figure.

In the present embodiment, the input device 9 receives an input for the start of operation from an operator. Once the operator provides the input for the start of operation to the input device 9, a movable die lowering step, a pressing step, and a movable die raising step are automatically carried out under the control of the controller 8. Alternatively, the input device 9 may receive an input for the start of movable die lowering and an input for the start of movable die raising individually from the operator.

The head-side pressure sensor 81 is disposed in the first supply/discharge line 61 and detects the pressure in the first supply/discharge line 61. Alternatively, the head-side pressure sensor 81 may be disposed in the tube 55 to detect the pressure in the head-side chamber 51.

The rod-side pressure sensor 82 is disposed in the second supply/discharge line 62 and detects the pressure in the second supply/discharge line 62. Alternatively, the rod-side pressure sensor 82 may be disposed in the tube 55 to detect the pressure in the rod-side chamber 52.

Further, the controller 8 is electrically connected also to a stroke sensor 83 disposed in the cylinder 5. The stroke sensor 83 is a sensor for detecting that the movable die 10 has reached a pressing start position (corresponding to the "predetermined position" as defined in the present invention).

The flow of the control performed by the controller 8 will now be described. It should be noted that the movable die 10 is lowered from a stand-by position to the pressing start position in the movable die lowering step, then further lowered from the pressing start position to a press completion position in the pressing step, and raised from the press completion position to the stand-by position in the movable die raising step.

1. Movable Die Lowering Step

Once the operator provides an input for the start of operation to the input device 9, the controller 8 outputs the rotational direction command to the servo amplifier 7 such that the servomotor 2 rotates in a direction that causes the movable die 10 to be lowered. The controller 8 further outputs the rotational speed command to the servo amplifier 7 such that the movable die 10 is lowered at a predetermined speed V1. Additionally, when the movable die 10 is lowered by its own weight, the controller 8 outputs the regenerative torque command to the servo amplifier 7 such that a pressure Pr detected by the rod-side pressure sensor 82 becomes a predetermined value $\alpha$ (e.g., 2 to 30 MPa). For example, when the pressure Pr detected by the rod-side pressure sensor 82 is above the predetermined value $\alpha$, the regenerative torque command to decrease the regenerative torque is output, while when the detected pressure Pr is below the predetermined value $\alpha$, the regenerative torque command to increase the regenerative torque is output.

It should be noted that whether the movable die 10 is being lowered by its own weight is determined based on the presence or absence of the regenerative torque generated in the servomotor 2, namely based on whether an electric current is generated in the servo amplifier 7. This electric current can be made to flow backward through a power supply line and used in another installation.

Further, in the movable die lowering step, the controller 8 outputs the tilt angle command to the first regulator 35 such that a pressure Ph detected by the head-side pressure sensor 81 is maintained within a predetermined range (e.g., the range of 0 to 1 MPa). For example, when the pressure Ph detected by the head-side pressure sensor 81 is or is likely to be above the upper limit of the predetermined range, the tilt angle command to decrease the delivery capacity of the first bidirectional pump 3 is output, while when the detected pressure Ph is or is likely to be below the lower limit of the predetermined range, the tilt angle command to increase the delivery capacity of the first bidirectional pump 3 is output.

Denoting the delivery capacity of the first bidirectional pump 3 by q1, the delivery capacity of the second bidirectional pump 4 by q2, the area of the head-side chamber 51 by Ah, and the area of the rod-side chamber 52 by Ar, the relationship among q1, q2, Ah, and Ar is expressed by the equation given below. In the equation, Aq represents the amount of adjustment made based on the pressure Ph detected by the head-side pressure sensor 81.

$$q1=q2\times Ah/Ar\pm\Delta q$$

2. Pressing Step

Once the stroke sensor 83 detects that the movable die 10 has reached the pressing start position, the controller 8 proceeds to the pressing step. In the pressing step, the controller 8 outputs the rotational speed command to the servo amplifier 7 such that the movable die 10 is lowered at a predetermined speed V2. The predetermined speed V2 in this step is lower than the predetermined speed V1 in the movable die lowering step (for example, V2 is 50% or less of V1).

In the pressing step, as in the movable die lowering step, when the movable die 10 is lowered by its own weight, the controller 8 outputs the regenerative torque command to the servo amplifier 7 such that the pressure Pr detected by the rod-side pressure sensor 82 becomes the predetermined value $\alpha$ (e.g., 2 to 30 MPa).

Further, in the pressing step, the controller 8 outputs the tilt angle command to the first regulator 35 such that the pressure Ph detected by the head-side pressure sensor 81 increases to a target pressure Pt. In general, the delivery capacity of the first bidirectional pump 3 is gradually increased.

After the pressure Ph detected by the head-side pressure sensor 81 reaches the target pressure Pt, the controller 8 outputs the rotational speed command to the servo amplifier 7 such that the rotational speed of the servomotor 2 becomes a predetermined value Nc. The predetermined value Nc is desirably a minimum rotational speed required to maintain the target pressure Pt, but may be higher than the minimum rotational speed.

The controller 8 further outputs the tilt angle command to the first regulator 35 such that the pressure Ph detected by the head-side pressure sensor 81 is maintained at the target pressure Pt. The hydraulic liquid is leaked in the first bidirectional pump 3, and the leaked hydraulic liquid is returned to the tank 60 through a drain line (not shown). Due to such internal leakage of the first bidirectional pump 3, the delivery capacity of the first bidirectional pump 3 for maintaining the target pressure Pt is not zero.

3. Movable Die Raising Step

Once a timer of the controller 8 detects that a predetermined time has elapsed after the pressure Ph detected by the head-side pressure sensor 81 reached the target pressure Pt or after the stroke sensor 83 detected reaching of the pressing start position by the movable die 10, the controller 8 outputs the rotational direction command to the servo amplifier 7 such that the servomotor 2 rotates in a direction that causes the movable die 10 to be raised. The controller 8 further outputs the rotational speed command to the servo amplifier 7 such that the movable die 10 is raised at a predetermined speed V3. The predetermined speed V3 in this step may be equal to or different from the predetermined speed V1 in the movable die lowering step.

Further, in the movable die raising step, the controller 8 outputs the tilt angle command to the first regulator 35 such that the pressure Ph detected by the head-side pressure sensor 81 is maintained within a predetermined range (e.g., the range of 0 to 1 MPa).

In the hydraulic system 1A of the present embodiment, as described above, the second bidirectional pump 4 is coupled to the first bidirectional pump 3 in a manner enabling torque to be transmitted between the first and second bidirectional pumps 3 and 4, and thus the second bidirectional pump 4 is driven together with the first bidirectional pump 3 once the first bidirectional pump 3 is driven by the servomotor 2. Additionally, since the first bidirectional pump 3 is a variable displacement pump whose delivery capacity per rotation is freely variable, the delivery capacity ratio between the first and second bidirectional pumps 3 and 4 can be appropriately set according to the difference in area between the head-side and rod-side chambers 51 and 52 of the cylinder 5 even if the rotational speed ratio between the first and second bidirectional pumps 3 and 4 is constant. The fact that the first bidirectional pump 3 is a variable displacement pump further makes it possible to more appropriately control the pressures in the two supply/discharge lines 61 and 62 despite the influence of factors such as the compressibility in the supply/discharge lines 61 and 62. Thus, a reactive force can be applied against extension of the cylinder 5 without the use of any counterbalance valve. In consequence, the speed etc. of the cylinder 5 can be stably controlled when the movable die 10 is lowered by extension of the rod 57.

In particular, when the control in the movable die lowering step is performed as described above, the benefits mentioned above can be reliably obtained without being affected by that amount of internal leakage occurring in the second bidirectional pump 4 which depends on the level of the pressure.

Further, during lowering of the movable die 10, the hydraulic oil discharged from the cylinder 5 flows into the second bidirectional pump 4, and thus the potential energy of the movable die 10 can be regenerated in the form of torque and rotational speed. At this time, since the delivery capacity ratio between the first and second bidirectional pumps 3 and 4 can be appropriately set, the occurrence of cavitation due to an excessively low head-side pressure Ph can be prevented. Additionally, even if the delivery capacity of the first bidirectional pump 3 and therefore the head-side pressure Ph become excessively high, an extra pressure occurring on the rod side can be regenerated in the form of the torque of the second bidirectional pump 4. Thus, also in this case, the energy efficiency is higher than in conventional techniques.

In conventional techniques, during pressing, it is inevitable in principle to maintain the head-side pressure while ensuring a reactive force by means of a counterbalance valve. In contrast, in the present embodiment, a reactive force can be exerted during pressing while the energy is regenerated in the second bidirectional pump 4. This leads to improved energy efficiency of the press machine.

Additionally, in the present embodiment, when the movable die 10 is lowered by its own weight, the regenerative torque of the servomotor 2 is controlled such that the pressure Pr detected by the rod-side pressure sensor 82 becomes the predetermined value $\alpha$. This allows the head-side pressure Ph to avoid becoming zero or a negative pressure, thereby preventing the occurrence of cavitation.

Additionally, during pressing, the tilt angle of the first bidirectional pump 3 is controlled such that the pressure Ph detected by the head-side pressure sensor 81 is maintained at the target pressure Pt. Thus, insufficiency of the head-side pressure Ph for pressing force generation can be prevented, and the head-side pressure Ph can be stably controlled at the target pressure.

Figure 4:
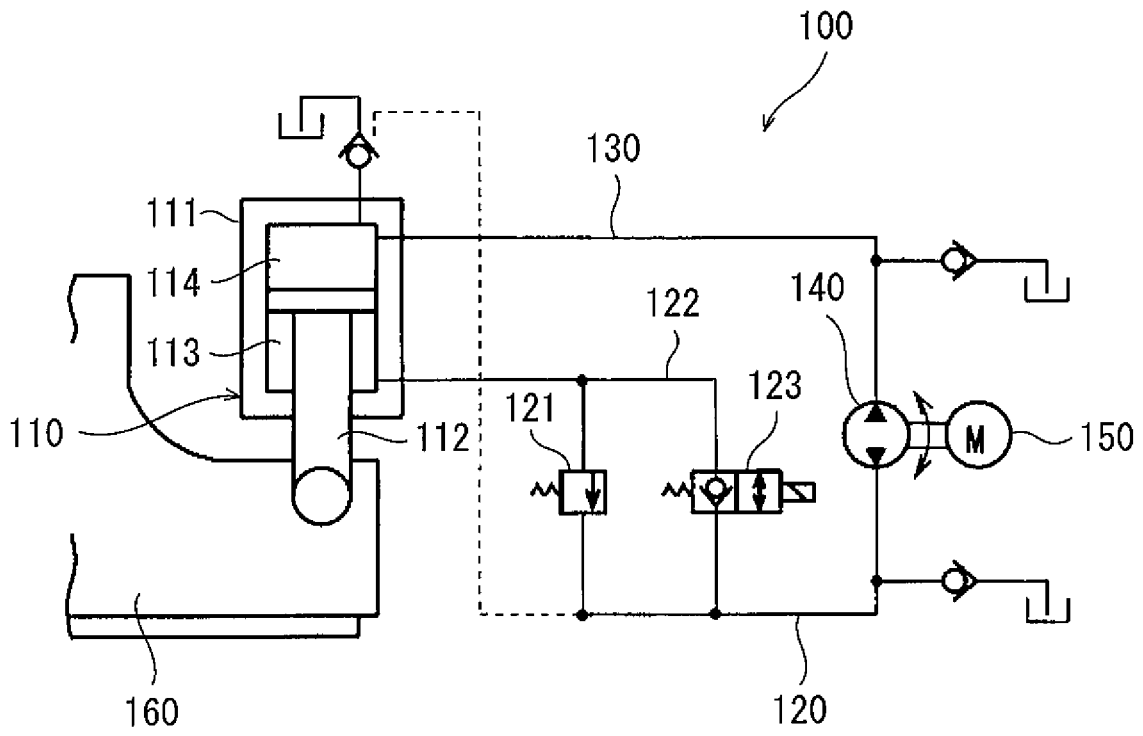
FIG. 4 is a schematic configuration diagram of a conventional hydraulic system.

In the conventional hydraulic system 100 as shown in FIG. 4, the two ports of the bidirectional pump 140 could be subjected to a high pressure, albeit not simultaneously. As such, the system 100 needs to use a special pump as the bidirectional pump 140 and requires high cost.

In contrast, in the present embodiment, the cylinder-opposite ports 32 and 42 of the first and second bidirectional pumps 3 and 4 are always held at low pressures. Thus, common pumps can be used as the first and second bidirectional pumps 3 and 4. With the use of two common pumps, the cost can be reduced compared to that required by the hydraulic system 100 using a special pump and a counterbalance valve.

In particular, when the cylinder-opposite port (32 or 42) of each of the first and second bidirectional pumps 3 and 4 has a larger diameter than the cylinder-side port (31 or 41) as in the present embodiment, since the internal passage of each pump that communicates with the cylinder-opposite port is subjected to a lower pressure than the passage communicating with the cylinder-side port, the internal passage need not be strong enough to withstand high pressures and can have an increased passage area. This can reduce the pressure drop which occurs when the hydraulic liquid is passing through the passage.

Further, since the present embodiment employs the inlet line 64 provided with the check valve 65 and the outlet line 66 provided with the outlet valve 67, insufficient flow rate of the hydraulic liquid sucked into the first or second bidirectional pump 3 or 4 and excessive increase in pressure in the relay line 63 can be prevented.

MODIFICATION EXAMPLE

Figure 2:
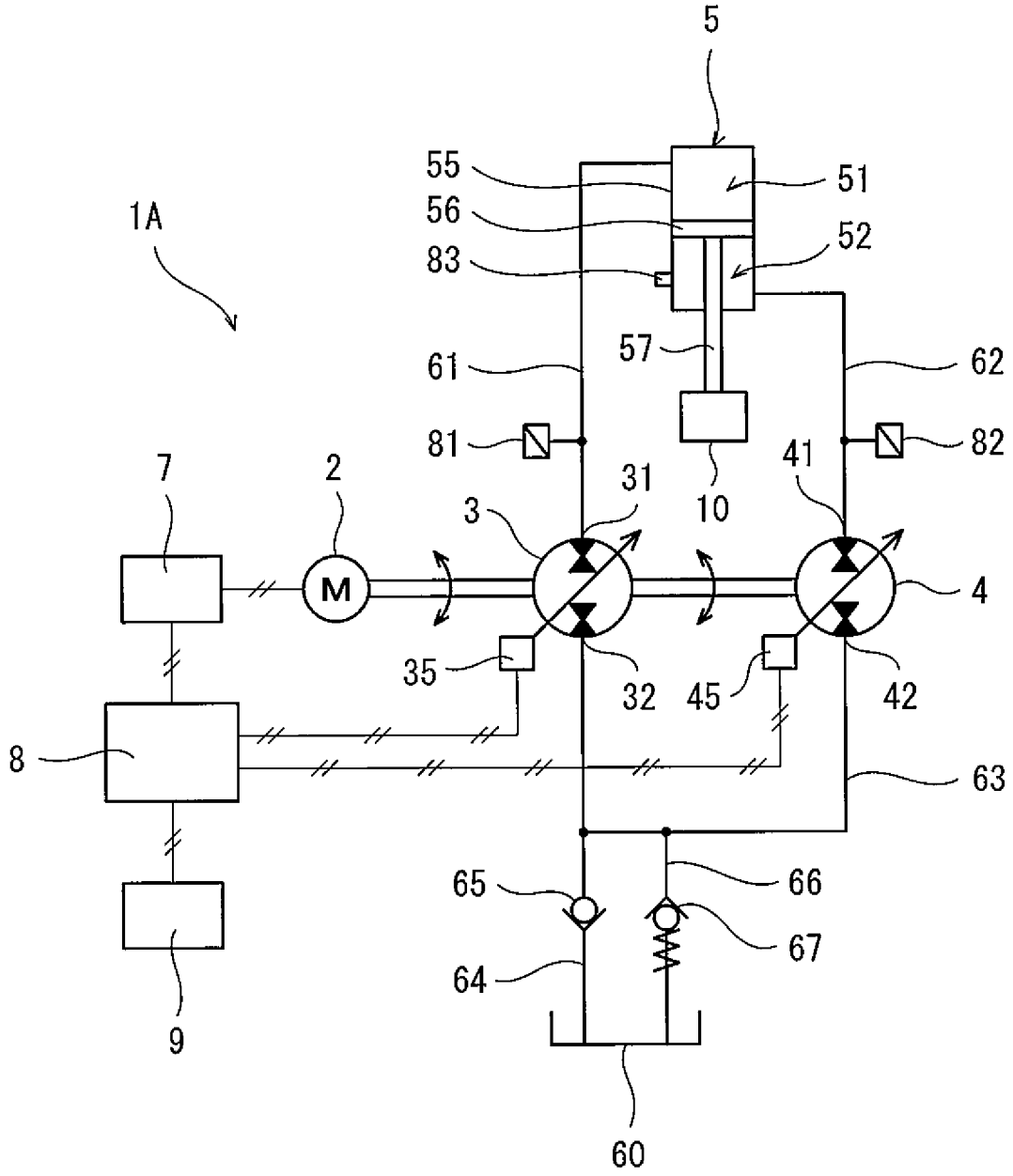
FIG. 2 is a schematic configuration diagram of a hydraulic system of a modification example of Embodiment 1.

As shown in FIG. 2, the second bidirectional pump 4 may be a variable displacement pump (a swash plate pump or bent axis pump) whose delivery capacity per rotation is selectively switchable between a first fixed value qa and a second fixed value qb greater than the first fixed value qa. In this configuration, the speed of the cylinder 5 can be switched between a low speed and a high speed.

When the second bidirectional pump 4 is the above-described variable displacement pump whose delivery capacity is selectively switchable, the tilt angle of the second bidirectional pump 4, which defines the delivery capacity, is regulated by a second regulator 45. The second regulator 45 regulates the tilt angle of the second bidirectional pump 4 in response to an electrical signal. For example, when the second bidirectional pump 4 is a swash plate pump, the second regulator 45 may be a regulator that electrically varies the hydraulic pressure acting on a servo piston coupled to the swash plate of the second bidirectional pump 4 or may be an electric actuator coupled to the swash plate of the second bidirectional pump 4.

When the second bidirectional pump 4 is the variable displacement pump whose delivery capacity is selectively switchable, the delivery capacity of the second bidirectional pump 4 is switched to the second fixed value qb in the movable die lowering step and movable die raising step, and to the first fixed value qa in the pressing step. During transition from the movable die lowering step to the pressing step, the delivery capacity of the second bidirectional pump 4 is instantaneously switched from the second fixed value qb to the first fixed value qa, and thus the delivery capacity of the first bidirectional pump 3 is significantly varied in response to the instantaneous switching. The other control-related features are the same as those in the embodiment previously described.

Embodiment 2

Figure 3:
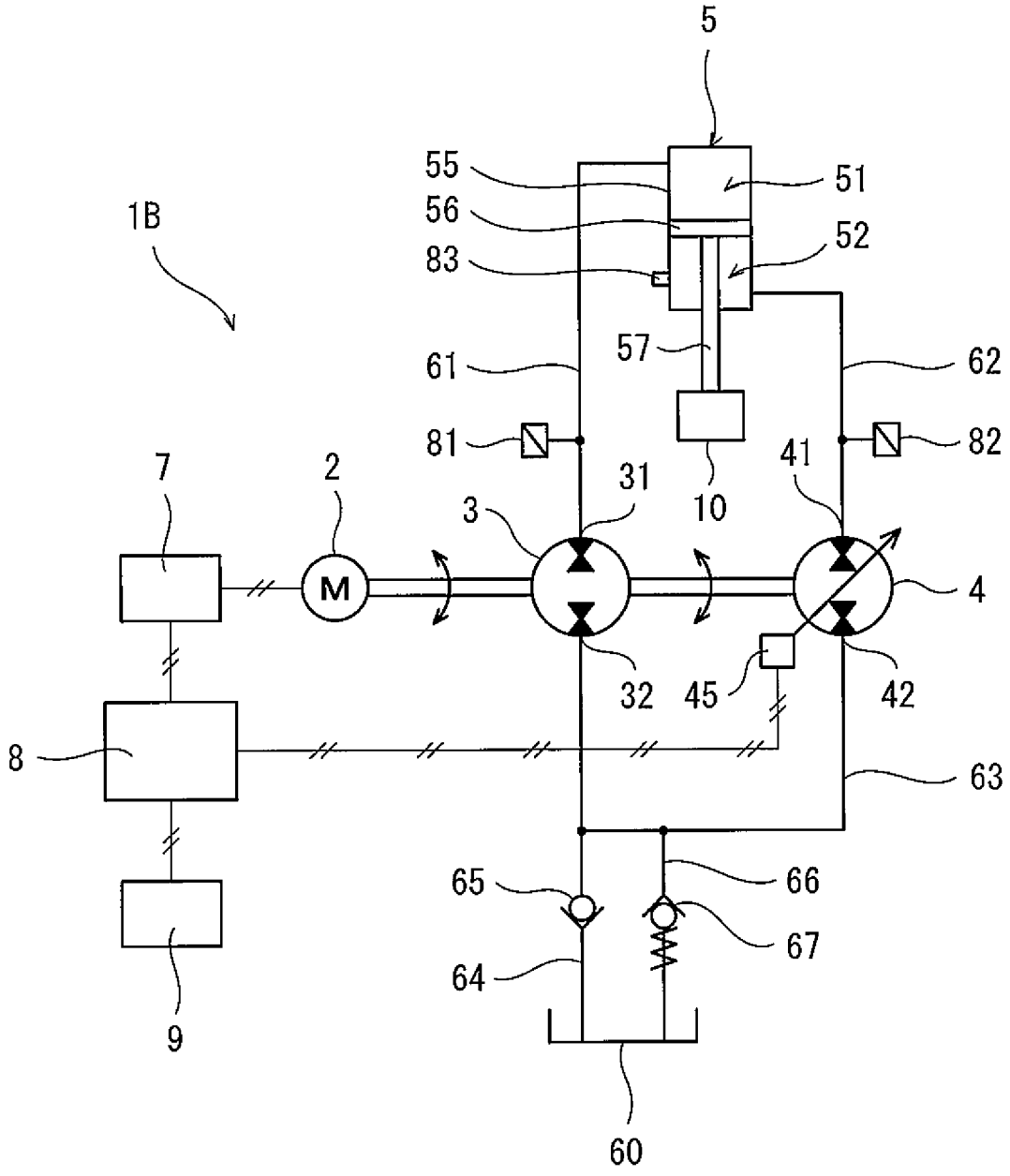
FIG. 3 is a schematic configuration diagram of a hydraulic system according to Embodiment 2 of the present invention.

FIG. 3 shows a hydraulic system 1B according to Embodiment 2 of the present invention. In the present embodiment, the elements which are the same as those of Embodiment 1 are denoted by the same reference signs, and repeated descriptions of these elements will not be given.

In the present embodiment, the first bidirectional pump 3 is a fixed displacement pump whose delivery capacity per rotation is invariable, and the second bidirectional pump 4 is a variable displacement pump (a swash plate pump or bent axis pump) whose delivery capacity per rotation is freely variable. The tilt angle of the second bidirectional pump 4, which defines the delivery capacity, is regulated by the second regulator 45 as in the modification example of Embodiment 1.

The flow of the control performed by the controller 8 will now be described.

1. Movable Die Lowering Step

Once the operator provides an input for the start of operation to the input device 9, the controller 8 outputs the tilt angle command to the second regulator 45 such that the delivery capacity of the second bidirectional pump 4 becomes a predetermined value qc. Denoting the delivery capacity of the first bidirectional pump 3 by q1, the area of the head-side chamber 51 by Ah, and the area of the rod-side chamber 52 by Ar, the predetermined value qc is expressed by the equation given below. That is, the predetermined value qc is determined by multiplying the delivery capacity q1 of the first bidirectional pump 3 by the ratio of the area Ar of the rod-side chamber 52 to the area Ah of the head-side chamber 51.

$$qc=q1\times Ar/Ah$$

Subsequently, the controller 8 outputs the rotational direction command to the servo amplifier 7 such that the servomotor 2 rotates in a direction that causes the movable die 10 to be lowered. The controller 8 further outputs the rotational speed command to the servo amplifier 7 such that the movable die 10 is lowered at the predetermined speed V1. Additionally, when the movable die 10 is lowered by its own weight, the controller 8 outputs the regenerative torque command to the servo amplifier 7 such that the pressure Pr detected by the rod-side pressure sensor 82 becomes the predetermined value α (e.g., 2 to 30 MPa). For example, when the pressure Pr detected by the rod-side pressure sensor 82 is above the predetermined value α, the regenerative torque command to decrease the regenerative torque is output, while when the detected pressure Pr is below the predetermined value α, the regenerative torque command to increase the regenerative torque is output.

After that, if the pressure Ph detected by the head-side pressure sensor 81 falls outside a predetermined range (e.g., the range of 0 to 1 MPa), the controller 8 corrects the rotational speed command output to the servo amplifier 7. For example, when the pressure Ph detected by the head-side pressure sensor 81 is above the upper limit of the predetermined range, the rotational speed command is corrected to decrease the rotational speed, while when the detected pressure Ph is below the lower limit of the predetermined range, the rotational speed command is corrected to increase the rotational speed.

2. Pressing Step

Once the stroke sensor 83 detects that the movable die 10 has reached the pressing start position, the controller 8 proceeds to the pressing step while maintaining the delivery capacity of the second bidirectional pump 4 at the predetermined value qc. In the pressing step, the controller 8 outputs the rotational speed command to the servo amplifier 7 such that the movable die 10 is lowered at the predetermined speed V2. The predetermined speed V2 in this step is lower than the predetermined speed V1 in the movable die lowering step (e.g., V2 is 50% or less of V1).

In the pressing step, as in the movable die lowering step, when the movable die 10 is lowered by its own weight, the regenerative torque command is output to the servo amplifier 7 such that the pressure Pr detected by the rod-side pressure sensor 82 becomes the predetermined value α (e.g., 2 to 30 MPa).

Further, in the pressing step, the controller 8 adjusts the rotational speed command output to the servo amplifier 7 such that the pressure Ph detected by the head-side pressure sensor 81 increases to the target pressure Pt. Additionally, the controller 8 adjusts the tilt angle command output to the second regulator 45 such that when the rotational speed has been increased, the tilt angle decreases as a function of the increase in rotational speed and that when the rotational speed has been decreased, the tilt angle increases as a function of the decrease in rotational speed.

After the pressure Ph detected by the head-side pressure sensor 81 reaches the target pressure Pt, the controller 8 continues the above-described adjustments of the rotational speed command and tilt angle command such that the pressure Ph detected by the head-side pressure sensor 81 is maintained at the target pressure Pt.

3. Movable Die Raising Step

Once a timer of the controller 8 detects that a predetermined time has elapsed after the pressure Ph detected by the head-side pressure sensor 81 reached the target pressure Pt or after the stroke sensor 83 detected reaching of the pressing start position by the movable die 10, the controller 8 outputs the rotational direction command to the servo amplifier 7 such that the servomotor 2 rotates in a direction that causes the movable die 10 to be raised. The controller 8 further outputs the rotational speed command to the servo amplifier 7 such that the movable die 10 is raised at the predetermined speed V3. The predetermined speed V3 in this step may be equal to or different from the predetermined speed V1 in the movable die lowering step.

Further, in the movable die raising step, the controller 8 outputs the tilt angle command to the second regulator 45 such that the delivery capacity of the second bidirectional pump 4 becomes a maximum delivery capacity permissible for the first bidirectional pump 3.

The present embodiment can provide the same benefits as Embodiment 1. In particular, in the present embodiment, since the rotational speed of the servomotor 2 and the tilt angle of the second bidirectional pump 4 are controlled during pressing, the amount of change in the head-side pressure Ph can be made smaller to achieve more stable control than when the tilt angle of the second bidirectional pump 4 is kept constant during pressing.

Modification Example

As in the modification example of Embodiment 1, the first bidirectional pump 3 may be a variable displacement pump (a swash plate pump or bent axis pump) whose delivery capacity per rotation is selectively switchable between a first fixed value qa and a second fixed value qb greater than the first fixed value qa. In this case, the delivery capacity of the first bidirectional pump 3 is switched to the second fixed value qb in the movable die lowering step and movable die raising step, and to the first fixed value qa in the pressing step. During transition from the movable die lowering step to the pressing step, the delivery capacity of the first bidirectional pump 3 is instantaneously switched from the second fixed value qb to the first fixed value qa, and thus the delivery capacity of the second bidirectional pump 4 is significantly varied in response to the instantaneous switching. The other control-related features are the same as those in the embodiment previously described.

Other Embodiments

The present invention is not limited to the embodiments described above, and various modifications can be made without departing from the gist of the present invention.

For example, the orientation of the cylinder 5 may be opposite to that in FIGS. 1 to 3, and the cylinder 5 may raise the movable die 10 by extension of the rod 57 and lower the movable die 10 by retraction of the rod 57. In this case, the potential energy of the movable die 10 is regenerated by the first bidirectional pump 3 during lowering of the movable die 10. It should be noted that even in this case, the control performed during raising of the movable die 10 to the predetermined position by extension of the cylinder 5 and the control performed during further raising of the movable die 10 from the predetermined position (during pressing) are the same as those in Embodiments 1 and 2.

Both the first and second bidirectional pumps 3 and 4 may be variable displacement pumps whose delivery capacities per rotation are freely variable. In this case, the control similar to that in Embodiment 1 or 2 can be accomplished if the delivery capacity of one of the first and second bidirectional pumps 3 and 4 is kept constant or is selectively switched between the first and second fixed values qa and qb.

It should be noted, however, that when one of the first and second bidirectional pumps 3 and 4 is a fixed displacement pump as in Embodiments 1 and 2 or is a variable displacement pump whose delivery capacity is selectively switchable as in the modification examples of Embodiments 1 and 2, the cost can be reduced compared to that required when both the first and second bidirectional pumps 3 and 4 are variable displacement pumps whose delivery capacities per rotation are freely variable.

Additionally, the hydraulic system of the present invention may be incorporated into a machine other than a press machine. That is, the moving object moved by the cylinder 5 in the vertical direction can be changed as appropriate depending on the type of the machine into which the hydraulic system is incorporated.

REFERENCE SIGNS LIST

1A, 1B hydraulic system
10 movable die (moving object)
2 servomotor
3 first bidirectional pump
35 first regulator
4 second bidirectional pump
45 second regulator
5 cylinder
51 head-side chamber
52 rod-side chamber
55 tube
56 piston
61 first supply/discharge line
62 second supply/discharge line
63 relay line
7 servo amplifier
8 controller
81 head-side pressure sensor
82 rod-side pressure sensor

The invention claimed is:

1. A hydraulic system comprising:

a cylinder that moves a moving object by extension and retraction of a rod and in which an interior of a tube is divided by a piston into a head-side chamber and a rod-side chamber;

a first bidirectional pump connected to the head-side chamber by a first supply/discharge line, the first bidirectional pump being a variable displacement pump whose delivery capacity per rotation is freely variable;

a second bidirectional pump connected to the rod-side chamber by a second supply/discharge line and coupled to the first bidirectional pump in a manner enabling torque to be transmitted between the first and second bidirectional pumps;

a relay line connecting the first and second bidirectional pumps such that a hydraulic liquid is sequentially discharged from one of the first and second bidirectional pumps and introduced into the other of the first and second bidirectional pumps both when the hydraulic liquid is discharged from the first bidirectional pump and when the hydraulic liquid is discharged from the second bidirectional pump;

a servomotor that drives the first or second bidirectional pump;

a regulator that regulates a tilt angle of the first bidirectional pump in response to an electrical signal;

a servo amplifier that controls a rotational speed of the servomotor;

a controller that outputs a rotational speed command to the servo amplifier and outputs a tilt angle command to the regulator; and a head-side pressure sensor that detects a pressure in the head-side chamber or the first supply/discharge line, wherein when the moving object is moved to a predetermined position by extension of the rod, the controller outputs the rotational speed command to the servo amplifier such that the moving object is moved at a predetermined speed and outputs the tilt angle command to the regulator such that the pressure detected by the head-side pressure sensor is maintained within a predetermined range.

2. The hydraulic system according to claim 1, wherein the second bidirectional pump is a fixed displacement pump whose delivery capacity per rotation is invariable or a variable displacement pump whose delivery capacity per rotation is selectively switchable between a first fixed value and a second fixed value.

3. The hydraulic system according to claim 1, wherein the hydraulic system is incorporated in a press machine, and during pressing in which the moving object is further moved from the predetermined position by extension of the rod, the controller outputs the rotational speed command to the servo amplifier such that the moving object is moved at a predetermined speed and outputs the tilt angle command to the regulator such that the pressure detected by the head-side pressure sensor increases to a target pressure.

4. The hydraulic system according to claim 3, wherein after the pressure detected by the head-side pressure sensor reaches the target pressure, the controller outputs the rotational speed command to the servo amplifier such that the rotational speed of the servomotor becomes a predetermined value and outputs the tilt angle command to the regulator such that the pressure detected by the head-side pressure sensor is maintained at the target pressure.

5. The hydraulic system according to claim 1, wherein the cylinder is disposed to lower the moving object by extension of the rod, the hydraulic system further comprises a rod-side pressure sensor that detects a pressure in the rod-side chamber or the second supply/discharge line, the servo amplifier further controls a regenerative torque of the servomotor, and when the moving object is lowered by its own weight, the controller outputs a regenerative torque command to the servo amplifier such that the pressure detected by the rod-side pressure sensor becomes a predetermined value.

6. A hydraulic system comprising:

a cylinder that moves a moving object by extension and retraction of a rod and in which an interior of a tube is divided by a piston into a head-side chamber and a rod-side chamber;

a first bidirectional pump connected to the head-side chamber by a first supply/discharge line;

a second bidirectional pump connected to the rod-side chamber by a second supply/discharge line and coupled to the first bidirectional pump in a manner enabling torque to be transmitted between the first and second bidirectional pumps, the second bidirectional pump being a variable displacement pump whose delivery capacity per rotation is freely variable;

a relay line connecting the first and second bidirectional pumps such that a hydraulic liquid discharged from one of the first and second bidirectional pumps is introduced into the other of the first and second bidirectional pumps;

a servomotor that drives the first or second bidirectional pump;

a regulator that regulates a tilt angle of the second bidirectional pump in response to an electrical signal;

a servo amplifier that controls a rotational speed of the servomotor;

a controller that outputs a rotational speed command to the servo amplifier and outputs a tilt angle command to the regulator; and a head-side pressure sensor that detects a pressure in the head-side chamber or the first supply/discharge line, wherein when the moving object is moved to a predetermined position by extension of the rod, the controller outputs the tilt angle command to the regulator such that the delivery capacity of the second bidirectional pump becomes a predetermined value, outputs the rotational speed command to the servo amplifier such that the moving object is moved at a predetermined speed, and corrects the rotational speed command output to the servo amplifier if the pressure detected by the head-side pressure sensor falls outside a predetermined range.

7. The hydraulic system according to claim 6, wherein the first bidirectional pump is a fixed displacement pump whose delivery capacity per rotation is invariable or a variable displacement pump whose delivery capacity per rotation is selectively switchable between a first fixed value and a second fixed value.

8. The hydraulic system according to claim 6, wherein the hydraulic system is incorporated in a press machine, during pressing in which the moving object is further moved from the predetermined position by extension of the rod, the controller outputs the rotational speed command to the servo amplifier such that the moving object is moved at a predetermined speed, adjusts the rotational speed command output to the servo amplifier such that the pressure detected by the head-side pressure sensor increases to a target pressure, and adjusts the tilt angle command output to the regulator such that when the rotational speed has been increased, the tilt angle decreases as a function of the increase in the rotational speed and that when the rotational speed has been decreased, the tilt angle increases as a function of the decrease in the rotational speed.

9. The hydraulic system according to claim 8, wherein after the pressure detected by the head-side pressure sensor reaches the target pressure, the controller continues the adjustment of the rotational speed command and the adjustment of the tilt angle command such that the pressure detected by the head-side pressure sensor is maintained at the target pressure.

10. The hydraulic system according to claim 6, wherein the cylinder is disposed to lower the moving object by extension of the rod, the servo amplifier further controls a regenerative torque of the servomotor, the hydraulic system further comprises a rod-side pressure sensor that detects a pressure in the rod-side chamber or the second supply/discharge line, and when the moving object is lowered by its own weight, the controller outputs a regenerative torque command to the servo amplifier such that the pressure detected by the rod-side pressure sensor becomes a predetermined value.

* * * * *